US005341731A

United States Patent [19]

Grizzard, Jr. et al.

[11] Patent Number: 5,341,731

[45] Date of Patent: Aug. 30, 1994

[54] MOBILE COMPACTOR OF DRUM CONTENTS

[75] Inventors: Bennett C. Grizzard, Jr., Moore, S.C.; Keith R. Brown, 604 Valhalla Dr., Columbia, S.C. 29223

[73] Assignee: Keith R. Brown, Columbia, S.C.

[21] Appl. No.: 123,708

[22] Filed: Sep. 17, 1993

Related U.S. Application Data

[63] Continuation of Ser. No. 965,880, Oct. 23, 1992, abandoned.

[51] Int. Cl.[5] ..... B30B 15/00; B30B 9/02

[52] U.S. Cl. ..... 100/100; 100/125; 100/131; 100/226; 100/229 A

[58] Field of Search ..... 100/100, 125, 131, 226, 100/229 A, 240, 245

[56] References Cited

U.S. PATENT DOCUMENTS

| | | | |
|---|---|---|---|
| 1,738,326 | 12/1929 | Smith | 100/100 X |
| 2,579,176 | 12/1951 | Dalton | 100/100 |
| 2,605,697 | 8/1952 | Bell et al. | 100/100 |
| 2,734,450 | 2/1956 | Bell et al. | 100/100 X |
| 2,782,710 | 2/1957 | Fishburne | 100/100 |
| 3,827,353 | 8/1974 | Isberg | 100/100 X |
| 3,862,595 | 1/1975 | Longo | 100/100 |
| 4,136,610 | 1/1979 | Tyler, Jr. | 100/100 |
| 4,152,035 | 5/1979 | Fox | 100/229 A X |
| 4,483,248 | 11/1984 | Ostreng | 100/100 X |

FOREIGN PATENT DOCUMENTS

| | | | |
|---|---|---|---|
| 223602 | 8/1959 | Australia | 100/100 |

OTHER PUBLICATIONS

"Ram Flat Compactors"; S and G Enterprises, Inc.; Brochure received Mar. 29, 1985.

*Primary Examiner*—Stephen F. Gerrity
*Attorney, Agent, or Firm*—Michael A. Mann

[57] ABSTRACT

A mobile, hydraulic-powered device for compacting the contents of containers, preferably 55 gallon drums. The compactor comprises a haulable frame having a pair of wheels, a compaction housing, two hydraulic cylinders, a hydraulic pump for operating the cylinders, a motor for operating the pump, and a complete system of operational control valves. The first hydraulic cylinder is mounted on top of the compaction housing and operates to drive a compaction plate down into a container positioned within the housing. The second hydraulic cylinder is pivotally mounted to the frame and is used to move the compaction housing between an operating position on the ground behind the frame and a transporting position up over the frame. Also, the compactor minimizes excess movement and the release of container liquids during compacting operation, which can apply a force of up to 1000 psi.

20 Claims, 4 Drawing Sheets

MOBILE COMPACTOR OF DRUM CONTENTS

This is a continuation of copending application(s) Ser. No. 07/965,880 filed on Oct. 23, 1992 now abandoned.

BACKGROUND OF THE INVENTION

1. Field of the Invention:

The present invention relates to devices for compacting the contents of containers. More particularly, the present invention relates to a transportable, hydraulic compactor for compacting wastes in drum containers.

2. Discussion of Background:

Hydraulic devices used for compacting are well known. Moreover, hydraulic compactors that compact the contents of drums or cylindrical containers, rather than the containers themselves, are known to exist. Also, some of these devices are mounted on wheel bases such as castors and, thus, can be moved short distances without inconvenience.

Such devices are disclosed, for example, in U.S. Pat. Nos. by Longo (3,862,595) and Fishburne (2,782,710). Longo features a vertical arm or column fixed to one side of a sturdy base that secures a cylindrical refuse container, such as a drum. The column has a ram located movably thereon and extending out over the container. The ram is moved into and out of the container to compact the refuse therein. The base is mounted on a set of castors and can be relocated when not in operation.

Similarly, Fishburne discloses a hydraulic press set on castors for movement across, say, the floor of a warehouse. The press has a vertically disposed hydraulic cylinder mounted over a pressing area. The cylinder is used for raising and lowering a ram relative to the frame of the press to compact the contents of a container located directly beneath the cylinder.

Although most compacting devices can be moved short distances and all can be loaded onto a suitable large vehicle or railroad flatcar, none of these devices can be hauled conveniently behind, say, a pickup truck. The previously known devices might also require partial disassembly prior to shipment.

A transportable compacting device that requires little or no effort to transport great distances between compacting operations is needed. It is believed that no such device exists.

SUMMARY OF THE INVENTION

According to its major aspects and broadly stated, the present invention is a device for compacting the contents of containers. In particular, it is a mobile, hydraulic-powered compactor for compacting the contents of 55 gallon drums. The compactor comprises a frame having a pair of wheels, a compaction housing, two hydraulic cylinders each containing a ram, a hydraulic pump for operating the cylinders, a motor for operating the pump, and a complete system of operational control valves. One of the hydraulic cylinders is vertically mounted on top of the compaction housing and operates its ram to drive a compaction plate down into a drum positioned within the housing. The other hydraulic cylinder is pivotally mounted to the frame and its ram is used to move the compaction housing between an operating position on the ground behind the frame and a transporting position up over the frame. Liquids in the container drain from the base of the housing and can be collected in a pan underlying the housing.

An important feature of the present invention is the pivoting of the compaction housing with respect to the compactor frame. The advantage of this feature is that the compaction housing can be moved between the operating position on the ground or other surface, when the hydraulic cylinder's ram is in an extended position, and the transporting position over the wheeled frame, when the cylinder's ram is in a retracted position. The housing is moved very easily and efficiently, allowing the mobile compactor to be transferred to various operating locations very rapidly and without any inconvenience, but also enabling the housing to be on a firm surface for compacting. No disassembly is required for transport; set up time is minimal.

Another feature of the present invention is the particular configuration of the compaction housing. The housing has an opening designed to easily receive a container for compaction, but still surrounds most of the container to protect workers from fluids splashing from the container during compaction of container contents. Also, a metal grid-type base supports the container during compaction and allows drainage of any fluid from the housing. A collecting pan placed underneath the base collects the drainage liquid for future processing. This feature enhances the entire compacting process by minimizing, if not eliminating, any clean-up subsequent to compacting.

Still another feature of the present invention is the use of screw jacks attached to the frame. This feature provides stability during compactor operation by minimizing the frame's excess movement or wobble during compaction. The screw jacks are sufficiently spaced apart along the frame so that when the screw jacks are lowered to engage the ground or other flooring surface, the wheels attached to the frame are slightly removed from the surface. Thus, any rotational movement by the wheels that results in excess compactor movement during operation is reduced, if not altogether eliminated.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
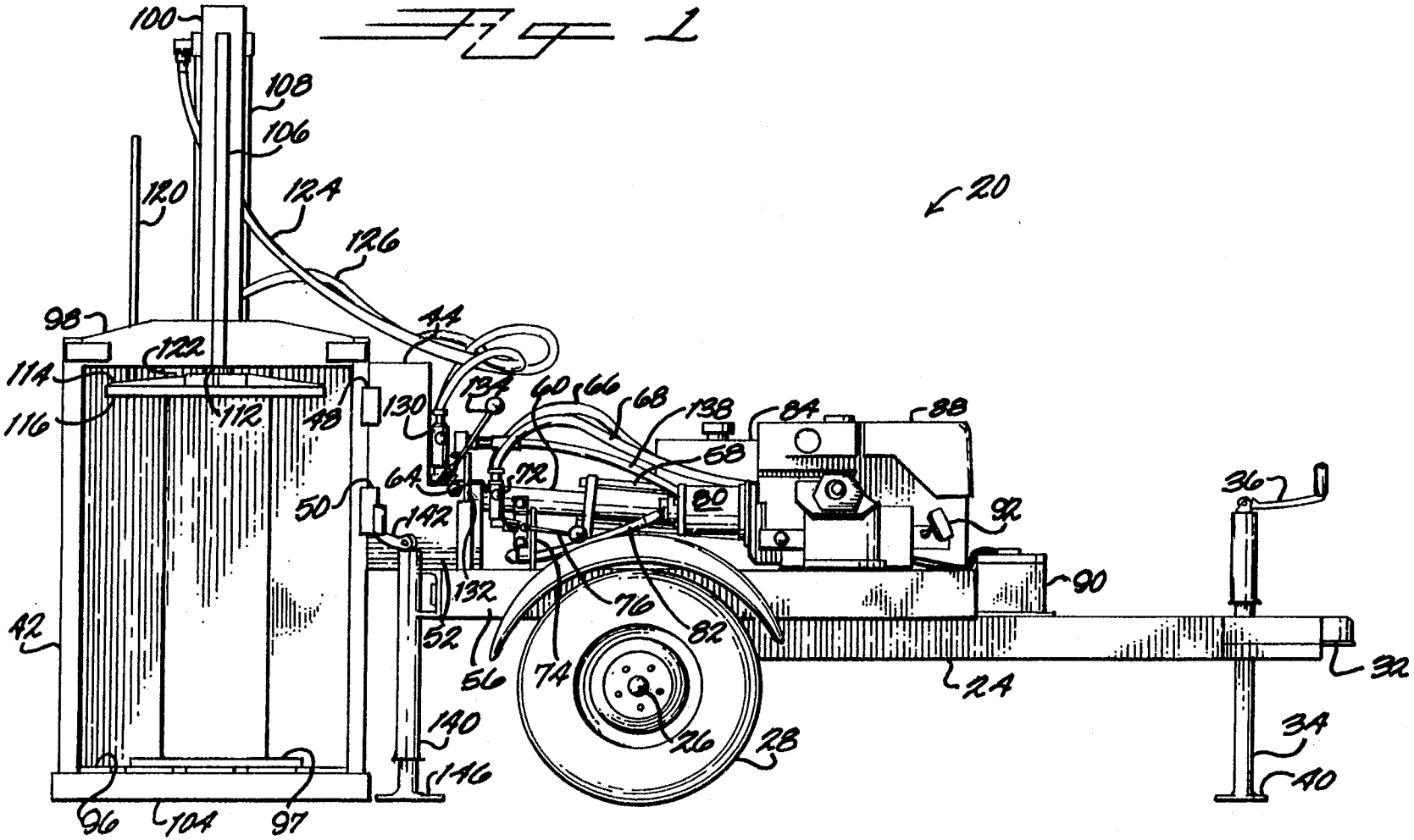
FIG. 1 is a side view of a mobile compactor according to a preferred embodiment of the present invention.

In the following description similar components are referred to using the same reference numerals in order to simplify the understanding of the sequential aspects of the drawings.

Referring now to FIG. 1, the mobile compactor 20 in its preferred embodiment comprises a frame 24 mounted on an axle 26 connecting a pair of wheels 28 (only one shown). Frame 24 has formed in it a recess 32, preferably a hitch, for attaching frame 24 to the rear of a transporting vehicle, such as a truck or automobile.

When frame 24 is not attached to a transporting vehicle, frame 24 may be supported by a screw jack 34, located at the front of frame 24 near recess 32. Screw jack 34 is connected to frame 24 so that when a handle 36 is rotated about screw jack 34, the relative position of frame 24 with respect to screw jack 34 can be raised or lowered, depending on the direction of rotation of handle 36. A foot 40 is attached to the bottom of screw jack 34 for providing stability while engaging the ground or other flooring surface.

Figure 3:
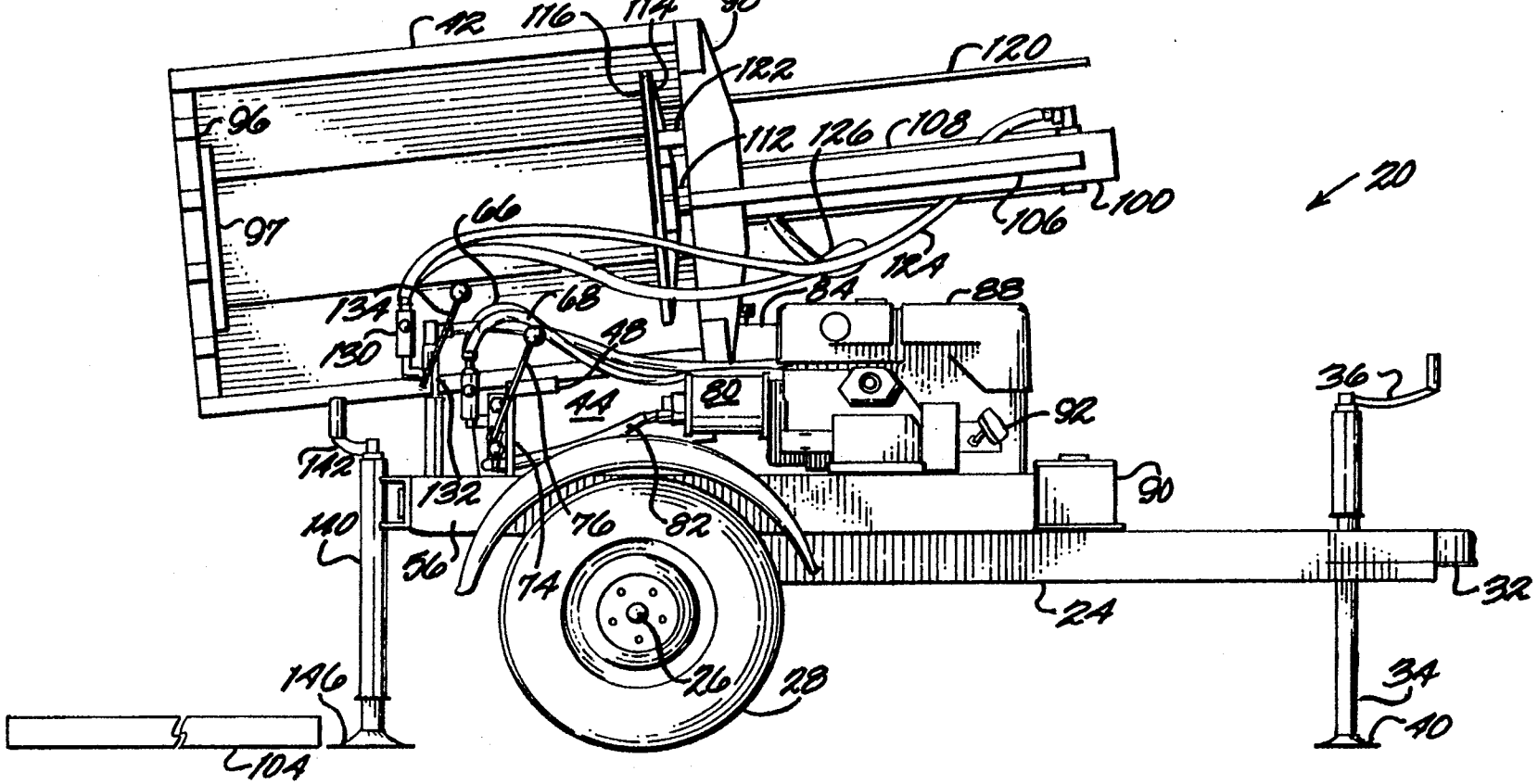
FIG. 3 is a side view of the mobile compactor of FIG. 1 shown just prior to transport.

Attached to the rear of frame 24 is a compaction housing 42. Housing 42 has connected to it a lateral extension 44, connected by a pair of welded connectors 48, 50. Extension 44 has a lower body 52, which pivotally attaches housing 42 to a rear area 56 of frame 24. Lower body 52 connects housing 42 to frame 24 via a pivoting assembly (not shown) located at rear area 56 so that housing 42 can be pivotally moved from an operating position, as shown in FIG. 1, to a transporting position, as shown in FIG. 3.

Referring again to FIG. 1, the movement of housing 42 with respect to frame 24 is powered by a hydraulic cylinder 58, which is mounted on frame 24. Hydraulic cylinder 58 contains a ram 60 that is axially aligned within cylinder 58. Ram 60 has a distal end 64 that is connected to lower body 52 of extension 44. The nature of the operation of cylinder 58 allows ram 60 to be axially extended out of and retracted into cylinder 58.

The connection between distal end 64 of ram 60 to lower body 52 of extension 44 causes housing 42 to pivot about frame 24 during the movement of ram 60 relative to cylinder 58. When ram 60 is in the extended position out of cylinder 58, housing 42 is in an operational position on the ground behind frame 24; when ram 60 is in the retracted position within cylinder 58, housing 42 is in a stowed, transporting position over frame 24.

The movement of ram 60 into and out of cylinder 58 is dictated by the pressure and direction of hydraulic fluid being pumped to cylinder 58 through a pair of hoses 66, 68. A valve system 72, mounted on frame 24 via a mounting plate 74 and operated by handle 76, is connected to hoses 66, 68, thereby controlling the movement of ram 60 between an extended position and a retracted position.

Hydraulic power is supplied to cylinder 58 by means of a hydraulic pump 80, which is connected to valve system 72 by hose 82. Valve system 72 controls the flow direction of hydraulic fluid to cylinder 58, thereby determining the movement of ram 60 into or out of cylinder 58.

Figure 4:
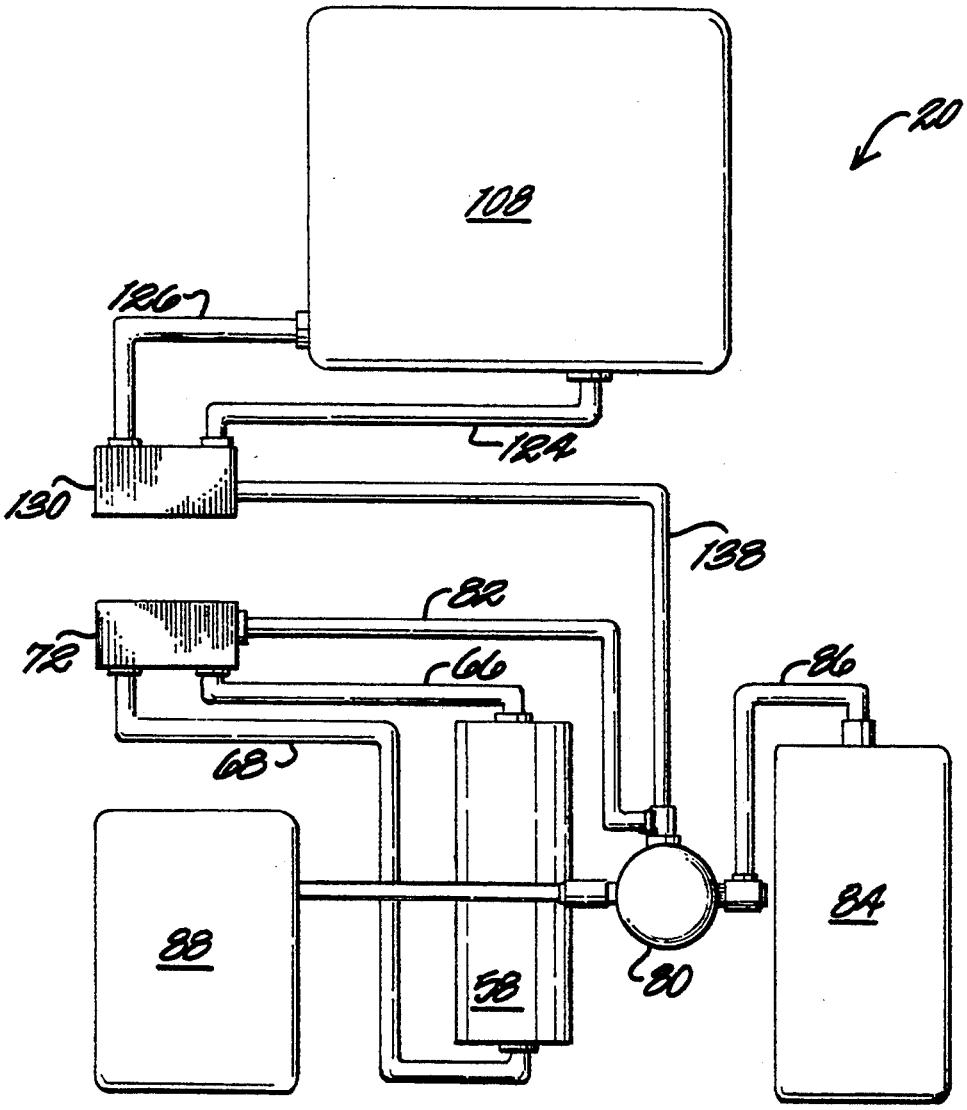
FIG. 4 is a schematic view of the operational features of the mobile compactor of FIG. 1.

A hydraulic fluid reservoir 84, attached to frame 24, supplies pump 80 with hydraulic fluid through hose 86 (shown schematically in FIG. 4). Referring back to FIG. 1, pump 80 is mounted to and powered by a motor or engine 88, preferably an eleven horsepower electric engine mounted on frame 24. A battery 90, connected to engine 88 and mounted on the front portion of frame 24, is used to start engine 88. Alternatively, engine 88 may be started manually by an auxiliary pull cord 92.

Housing 42 is preferably a three-sided structure dimensioned to receive a container 94 (shown in FIG. 2), preferably a 55-gallon drum. Container 94, when positioned within housing 42, is supported by a heavy grid-like base 96 and a rectangular plate 97 mounted on base 96. Plate 97, preferably $\frac{1}{4}$ inch thick, supports the bottom of container 94 to prevent it from bulging out through base 96 during compaction. Housing 42 has a top 98, which covers housing 42 and provides a mount for a compaction assembly 100. A pan 104 is positioned underneath base 96 for collecting any spillage from container 94 that might occur during compaction.

Compaction assembly 100 is preferably mounted on top 98 so that it extends vertically above housing 42. Its mount is stabilized by a pair of arms 106 (only one shown) welded to both assembly 100 and top 98 of housing 42. Mounted vertically within assembly 98 is a second hydraulic cylinder 108, similar to hydraulic cylinder 58, having a arm 110 extending through top 98. Preferably, hydraulic cylinder 108 can supply hydraulic power up to 1000 pounds per square inch (psi).

Ram 110 has a distal end 112 (see FIG. 1) connected to a compaction plate 114 having a face 116 that is perpendicular to the axis of ram 110. Ram 110 and compaction plate 114 are preferably connected by threading compaction plate 114 onto distal end 112. A rod 120, connected to the side of compaction plate 114 and extending up through top 98, keeps compaction plate 114 from rotating axially during compaction.

The mounting of assembly 100 is oriented so that when ram 110 is axially extended out of second hydraulic cylinder 108, compaction plate 114, connected to distal end 112 of ram 110, is driven down through the interior of housing 42, with face 116 remaining parallel to base 96. Also, ram 110 can be retracted almost completely within second hydraulic cylinder 108, however, a stop 122 connected to the top of compaction plate 114 prevents ram 110 from raising compaction plate 114 any more than is shown in FIG. 1.

Similar to ram 60, the movement of ram 110 between an extended position out of second cylinder 108 and a retracted position into second cylinder 108 is dictated by the pressure and direction of hydraulic fluid being pumped to second cylinder 108 through hoses 124, 126. A second valve system 130, mounted on frame 24 by a second mounting plate 132 and operated by a handle 134, is connected to hoses 124, 126, thereby controlling the movement of ram 110 into and out of second hydraulic cylinder 108 (see also FIG. 4).

Hydraulic power is supplied to second hydraulic cylinder 108 by pump 80, which is connected to second valve system 130 by hose 138. As previously stated herein, pump 80 is supplied with hydraulic fluid by reservoir 84 and powered by engine 88.

A pair of rear screw jacks 140 (only one is shown) are connected to frame 24 just behind wheels 28 so that when a handle 142 is rotated about screw jack 140, the relative position of the back of frame 24 with respect to screw jack 140 can be raised or lowered, depending on the direction of rotation. A foot 146 is attached to the bottom of screw jack 140 for providing stability while engaging the ground or other flooring surface.

Rear screw jacks 140 are preferably used in conjunction with screw jack 34, located on the front of frame 24, to slightly lift frame 24 just prior to operation of compaction housing 42. The lifting of frame 24 reduces any shifting or excess wobble that frame 24 may otherwise undergo during compaction.

In use, when compactor 20 is being transported to a desired location, preferably by a truck or automobile, compaction housing 42 is stowed above frame 24 (as shown in FIG. 3). Upon arrival at the desired location, recess 32 is lifted off the truck's trailer hitch using screw jack 34. Similarly, the feet of rear screw jacks 140 are lowered slightly thereby lifting frame 24 to stabilize compactor 20 prior to operation.

Figure 2:
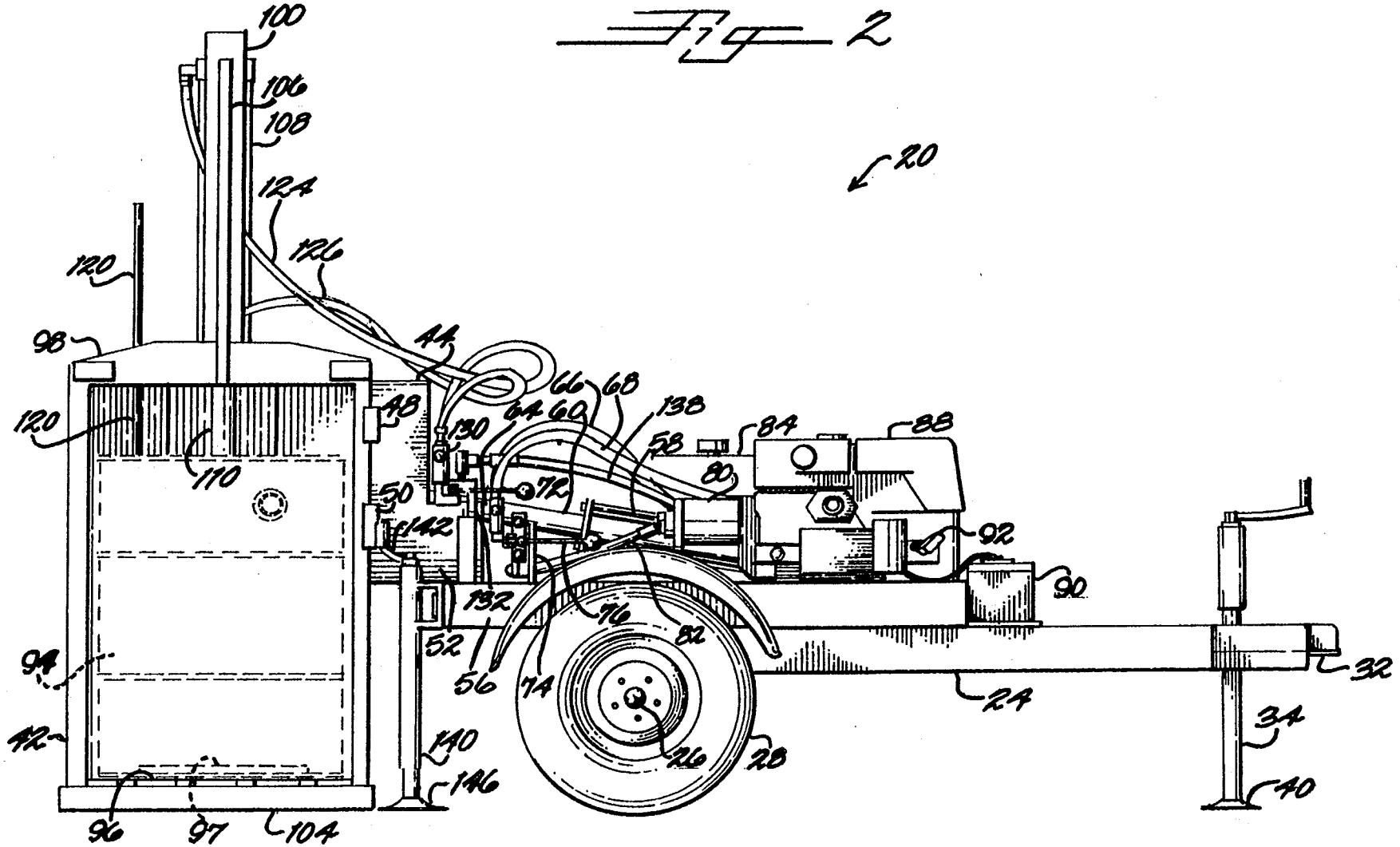
FIG. 2 is a side view of the mobile compactor of FIG. 1 showing compacting operation.

Next, pan 104 is positioned on the flooring surface a known distance behind frame 24. Valve system 72 is operated via handle 76 to extend ram 60 out of cylinder 58, thereby lowering compaction housing 42 from its stowed or transporting position (as shown in FIG. 3) to its operating position (as shown in FIGS. 1, 2). The lowering of housing 42 is complete when its base 96 is received by pan 104. At this point, ram 110 should be retracted to the position where stop 122 engages the underside of top 98, as shown in FIGS. 1, 3.

Referring to FIG. 2, container 94, such as a 55 gallon drum, holding material to be compacted, is positioned within the interior of housing 42. It is crucial that container 94 be positioned directly beneath compaction plate 114, since the size and shape of compaction plate 114 is nearly identical to the opening of container 94.

Once container 94 is properly positioned within housing 42, valve system 130 is operated to provide hydraulic power to second cylinder 108 thereby extending ram 110 out of cylinder 108. The pressure applied by cylinder 108 is typically limited to 1000 psi. The extension of ram 110 out of cylinder 108 extends compaction plate 114 down into the interior of container 94, compacting its contents. The walls of housing 42 prevent any liquids in container 94 from splashing or otherwise being displaced. Also, base 96, being made of a grid or grating, allows such spilled liquids to collect in pan 104 for future processing.

Upon completion of compacting the contents of container 94, valve system 130 is used to retract ram 110 into cylinder 108, thereby raising compaction plate 114 out of container 94 until the stop 122 engages the underside of top 98. Container 94 can then be removed from housing 42, which is then ready for the next container to be compacted.

Upon completion of all containers at the desired location, hydraulic cylinder 58, controlled by valve system 72, is then used to retract ram 60 back into cylinder 58, thereby moving housing 42 from its operating position (FIGS. 1, 2) to its transporting position (FIGS. 3). Frame 24 is then lowered using screw jacks 34, 140 so that recess 32 mounts on the transporting mechanism location on the transporting means, such as a truck. Compactor 20 is then ready to be transported to the next compacting site.

It will be apparent to those skilled in the art that many changes and substitutions can be made to the preferred embodiment herein described without departing from the spirit and scope of the present invention as defined by the appended claims.

What is claimed is:

1. Mobile apparatus for compacting contents of a container of waste and for use with means for transporting said apparatus, said apparatus comprising:

a frame;

a housing pivotally carried by said frame, said housing having a base with at least one hole for draining fluids from said housing, said housing dimensioned to receive said container;

means carried by said housing for compacting the contents of said container; and a hydraulic cylinder carried by said frame for pivoting said housing with respect to said frame between a first position for compacting and a second position for transporting, said cylinder including a ram attached to the housing and the ram moving between a retracted position and an extended position, said housing being in said first position when said ram is in said extended position and in said second position when said ram is in said retracted position, said housing being held over said frame by said hydraulic cylinder when said housing in said second position.

2. The apparatus as recited in claim 1, wherein said ram is pivotally attached to said housing and said cylinder is pivotally attached to said frame.

3. The apparatus as recited in claim 1, wherein said compacting means further comprises:

a second hydraulic cylinder carried by said housing, said second cylinder carrying a second ram having a proximal end and a distal end and moving between retracted position and an extended position; and a plate connected to said distal end of said second ram so that when said container is positioned within said housing and said second ram moves from said retracted position to said extended position, said contents of said container are compacted.

4. The apparatus as recited in claim 1, wherein said housing has a top and said compacting means further comprises:

a second hydraulic cylinder attached to said top of said housing and oriented so that said second cylinder is vertical when said housing is in said first position, said second cylinder carrying a second ram having a proximal end and a distal end and moving between a retracted position and an extended position, said distal end within said housing and said proximal end above said housing;

a compaction plate connected to said distal end of said second ram so that when said container is positioned within said compaction housing and said second ram moves from said retracted position to said extended position, said contents of said container are compacted; and means in fluid communication with said second hydraulic cylinder for pumping hydraulic fluid to said second hydraulic cylinder.

5. The apparatus as recited in claim 1, wherein said housing further comprises:

a top; and a wall connecting said top to said base, said wall having an opening dimensioned for allowing a container to be placed inside said housing.

6. The apparatus as recited in claim 1, wherein said apparatus further comprises a plurality of screw jacks carried by said frame, each of said plurality of screw jacks having a ground-engaging foot for stabilizing said frame during operation of said compacting means.

7. The apparatus as recited in claim 1, further comprising:

an axle carried by said frame; and a pair of wheels on said axle.

8. The apparatus as recited in claim 1, further comprising a trailer hitch carried by said frame for connecting said apparatus to said transporting means.

9. Mobile apparatus for compacting contents of a container of waste, said apparatus for use with a cylindrical container and a means for transporting said apparatus on a surface, said apparatus comprising:

a frame;

a housing pivotally attached to said frame, said housing having a base having at least one hole for draining fluids from said housing, said housing dimensioned to hold said container within said housing;

hydraulic means carried by said housing for compacting the contents of said container; and a hydraulic cylinder carried by said frame for pivoting said housing about said frame, said cylinder including a ram attached to said housing and said ram moving between a retracted position and an extended position, said cylinder pivotally moving said housing between a first position and a second position, said housing being in said first position wherein said base of said housing is on said surface when said ram is in said extended position, said housing being in said second position wherein said housing is held over said frame for transporting when said ram is in said retracted position.

10. The apparatus as recited in claim 9, wherein said ram is pivotally attached to said housing and said cylinder is pivotally attached to said frame.

11. The apparatus as recited in claim 9, wherein said compacting means further comprises:

a second hydraulic cylinder carried by said housing, said second cylinder carrying a second ram having a proximal end and a distal end, said second ram moving between a retracted position and an extended position with respect to said second cylinder; and a plate connected to said distal end of said second ram so that when said container is positioned within said housing and said second ram moves from said retracted position to said extended position, said contents of said container are compacted.

12. The apparatus as recited in claim 9, wherein said housing has a top and said compacting means further comprises:

a second hydraulic cylinder attached to said top of said housing and oriented so that said second cylinder is vertical when said housing is in said first position, said second cylinder carrying a second ram having a proximal end and a distal end, said second ram moving between a retracted position and an extended position with respect to said second cylinder, said distal end within said housing and said proximal end above said housing;

a compaction plate connected to said distal end of said second ram so that when said container is positioned within said compaction housing and said second ram moves from said retracted position to said extended position, said contents of said container are compacted; and means in fluid communication with said second hydraulic cylinder for pumping hydraulic fluid to said second hydraulic cylinder.

13. The apparatus as recited in claim 9, wherein said apparatus further comprises a plurality of screw jacks carried by said frame, each of said plurality of screw jacks having a surface-engaging foot for stabilizing said frame during operation of said compacting means.

14. The apparatus as recited in claim 9, further comprising:

an axle carried by said frame; and a pair of wheels on said axle.

15. The apparatus as recited in claim 9, further comprising:

a first valve system carried by said frame for operating said compacting means;

a second valve system carried by said frame for operating said pivoting means; and control means carried by said frame for operating said first and second valve systems.

16. The apparatus as recited in claim 9, wherein said container has a bottom, and wherein said housing further comprises a plate attached on said base and dimensioned to support said bottom when said container is positioned within said housing and said container contents are being compacted.

17. Apparatus for compacting the contents of a waste container, said apparatus adapted to be hauled behind a vehicle, said apparatus comprising:

a frame having an axle, means for connecting said apparatus to said vehicle, and a plurality of screw jacks, each of said plurality of screw jacks having a surface-engaging foot for stabilizing said frame during operation of said apparatus;

a pair of wheels attached to said axle;

a housing pivotally carried by said frame, said housing having a top, a base having at least one hole for draining fluids from said housing, and a wall having an opening dimensioned to receive said container, said wall having a top connected to said top of said housing and a bottom connected to said base;

a first hydraulic cylinder including a first ram having a proximal end and a distal end, said first ram moving between a retracted position and an extended position with respect to said first cylinder;

a plate connected to said distal end of said first ram so that when said container is positioned within said compaction housing and said first ram moves from said retracted position to said extended position, said contents of said container are compacted;

means for actuating said first hydraulic cylinder; and a second hydraulic cylinder carried by said frame for pivoting said housing about said frame, said second hydraulic cylinder including a second ram attached to the housing and the second ram having a proximal end and a distal end, a retracted position and an extended position, said second cylinder pivotally moving said housing between a first position when said second ram of said second hydraulic cylinder is in said extended position and a second position when said second ram of said second hydraulic cylinder is in said retracted position, said first position placing said base of said housing on said surface, said second position placing said housing over said frame for transporting.

18. The apparatus as recited in claim 17, wherein said base having at least one hole is a grid.

19. The apparatus as recited in claim 17, wherein said base having at least one hole is a grid with a plate mounted on said grid for supporting said waste container when said contents of said container are being compacted.

20. The apparatus as recited in claim 17, wherein said base having at least one hole is a grid, and said apparatus further comprises a pan for placing under said grid, said pan collecting said fluids drained from said base.

* * * * *